US012697527B2

(12) United States Patent
Zhou et al.

(10) Patent No.: US 12,697,527 B2
(45) Date of Patent: Aug. 4, 2026

(54) LIFTING AND FOLDING TREADMILL

(71) Applicant: Sunlink (Xiamen) Sports Equipments Industrial Co., Ltd., Xiamen (CN)

(72) Inventors: Hengjun Zhou, Xiamen (CN); Xiqun Lin, Xiamen (CN)

(73) Assignee: Sunlink (Xiamen) Sports Equipments Industrial Co., Ltd., Xiamen (CN)

( * ) Notice: Subject to any disclaimer, the term of this patent is extended or adjusted under 35 U.S.C. 154(b) by 73 days.

(21) Appl. No.: 18/962,008

(22) Filed: Nov. 27, 2024

(65) Prior Publication Data

US 2026/0084004 A1 Mar. 26, 2026

(30) Foreign Application Priority Data

Sep. 23, 2024 (CN) ..... 202422316901.3

(51) Int. Cl.
*A63B 22/00* (2006.01)
*A63B 22/02* (2006.01)
*A63B 24/00* (2006.01)

(52) U.S. Cl.
CPC ..... *A63B 22/0046* (2013.01); *A63B 22/02* (2013.01); *A63B 24/0087* (2013.01); *A63B 2210/50* (2013.01); *A63B 2225/093* (2013.01)

(58) Field of Classification Search
CPC . A63B 22/0046; A63B 22/02; A63B 24/0087; A63B 2210/50; A63B 2225/093; A63B 22/0235; A63B 21/15; A63B 2210/05
See application file for complete search history.

(56) References Cited

U.S. PATENT DOCUMENTS 6,090,016 A * 7/2000 Kuo ..... A63B 22/02 482/54
6,383,120 B1 * 5/2002 Lo ..... A63B 22/02 482/54
6,758,791 B1 * 7/2004 Kuo ..... A63B 22/0023 482/54
6,857,991 B2 * 2/2005 Yu ..... A63B 22/02 482/54
6,890,287 B2 * 5/2005 Chen ..... A63B 22/02 482/54
6,916,277 B2 * 7/2005 Chen ..... A63B 22/02 482/54
6,923,747 B1 * 8/2005 Chu ..... A63B 22/02 482/54
6,979,283 B2 * 12/2005 Pan ..... A63B 22/02 482/54

(Continued)

*Primary Examiner* — Garrett K Atkinson
(74) *Attorney, Agent, or Firm* — Cooper Legal Group, LLC

(57) ABSTRACT

Provided in the present disclosure is a lifting and folding treadmill, where a base is located below a running deck; a support has a bottom end pivoted to the base, and a top end tilted backwards and pivoted to a front half part of the running deck; one end of an electric push rod is pivoted to the base, with a pivot point located behind a pivot point between the support and the base, and the other end of the electric push rod is pivoted to the running deck, with a pivot point located in front of a pivot point between the support and the running deck; and a hook is configured to hook or release a front part of the running deck to or from the base. The present disclosure achieves lifting of a front end of the running deck and folding of the running deck.

8 Claims, 6 Drawing Sheets

(56) References Cited

U.S. PATENT DOCUMENTS

| | | | | |
|---|---|---|---|---|
| 7,004,887 | B2 * | 2/2006 | Pan | A63B 22/02 482/54 |
| 7,780,578 | B2 * | 8/2010 | Packham | A63B 22/02 482/4 |
| 10,065,070 | B2 * | 9/2018 | Huang | A63B 22/02 |
| 10,398,932 | B2 * | 9/2019 | Hamilton | A63B 22/02 |
| 10,589,147 | B1 * | 3/2020 | Kostadis | A63B 22/025 |
| 2002/0147078 | A1 * | 10/2002 | Wu | A63B 22/0023 482/54 |
| 2003/0195088 | A1 * | 10/2003 | Wang | A63B 22/0023 482/54 |
| 2003/0236153 | A1 * | 12/2003 | Pan | A63B 22/0235 482/54 |
| 2004/0132585 | A1 * | 7/2004 | Chen | A63B 22/02 482/54 |
| 2004/0248699 | A1 * | 12/2004 | Colley | A63B 22/02 482/54 |
| 2008/0234111 | A1 * | 9/2008 | Packham | A63B 22/02 482/54 |
| 2008/0280734 | A1 * | 11/2008 | Dickie | A63B 22/0023 482/54 |
| 2009/0005224 | A1 * | 1/2009 | Davis | A63B 22/0257 482/54 |
| 2009/0062072 | A1 * | 3/2009 | Packham | A63B 22/02 482/4 |
| 2015/0351553 | A1 * | 12/2015 | Herring | A47C 7/006 108/50.11 |
| 2018/0221707 | A1 * | 8/2018 | Weaver | A63B 22/02 |
| 2020/0215380 | A1 * | 7/2020 | Xing | A63B 22/025 |
| 2021/0299512 | A1 * | 9/2021 | Kostadis | A63B 22/0235 |

* cited by examiner

LIFTING AND FOLDING TREADMILL

CROSS-REFERENCE TO RELATED APPLICATION

This application claiming priority to Chinese Patent Application 202422316901.3, filed on Sep. 23, 2024, which is incorporated herein by reference.

TECHNICAL FIELD

The present disclosure relates to the technical field of fitness equipment, in particular to a lifting and folding treadmill.

BACKGROUND

Some existing fitness equipment is provided with running decks, such as those on treadmills. During use, the front end of the running deck needs to be able to ascend or descend to form different slopes. When not in use, the running deck can extend a large distance forwards and backwards, which takes up more space.

The problem of how to erect and fold the running deck while lifting the front end of the running deck by a simple structure remains to be solved.

SUMMARY

An objective of the present disclosure is to provide a lifting and folding treadmill, which solves the technical problem of how to erect and fold the running deck while lifting the front end of the running deck by a simple structure.

To achieve the above objective, a solution of the present disclosure is as follows: a lifting and folding treadmill, including a running deck, a base, a support, an electric push rod, and a hook, where the base is located below the running deck and configured to be supported on the ground;

a bottom end of the support is pivoted to the base, so that a top end of the support is capable of swinging forwards and backwards, and the top end of the support is tilted backwards and pivoted to a front half part of the running deck;

one end of the electric push rod is pivoted to the base, so that the other end of the electric push rod is capable of swinging forwards and backwards, a pivot point between the electric push rod and the base is located behind a pivot point between the support and the base, the other end of the electric push rod is pivoted to the running deck, and a pivot point between the electric push rod and the running deck is located in front of a pivot point between the support and the running deck; and the hook is configured to hook or release a front part of the running deck to or from the base, so as to limit lifting of the front part of the running deck after hooking, and cause the running deck to swing synchronously with the support.

Further, the base is provided with a lateral pin having an axis coaxial with a pivot shaft of the support pivoted to the base, one end of the hook is pivoted to the front part of the running deck, and the other end of the hook is capable of swinging forwards and backwards, so as to swing towards and be hooked on the lateral pin, or to swing away and be released from the lateral pin.

Further, the running deck is mounted with an electric pushing device configured to push the hook to swing towards the lateral pin, or to be released from the lateral pin.

Further, the electric pushing device includes a motor and a shifter lever, where the motor is mounted on the running deck and drives the shifter lever to rotate, the shifter lever is formed with an eccentric portion, and after the shifter lever rotates, the eccentric portion is driven to push the hook to swing towards the lateral pin, or to be released from the lateral pin.

Further, the hook is connected to an elastic component, and the elastic component elastically drives the hook to swing away from the lateral pin.

Further, when the hook is released from the base, a rear part of the running deck falls on the ground.

Further, a bottom side of the rear part of the running deck is mounted with rollers for frontward and backward rolling.

Further, a top side of the running deck is provided with a running belt along a front-rear direction.

With the above solution, the present disclosure has the following beneficial effects:

(1) When the hook is released from the front part of the running deck, the front part of the running deck can be driven by extension or retraction of the electric push rod to ascend or descend, so that the slope formed by the running deck can be adjusted. When hooked by the hook, the front part of the running deck is restricted from being lifted up. The running deck can be driven by extension or retraction of the electric push rod to swing with the support, so that the rear part of the running deck can be tilted upwards to achieve erection and folding of the running deck, thereby saving more space after folding.

(2) The electric control on the hook is achieved by the electric pushing device and the elastic component, making it more convenient to switch between hooking of the hook and release from the running deck.

Figure 1:
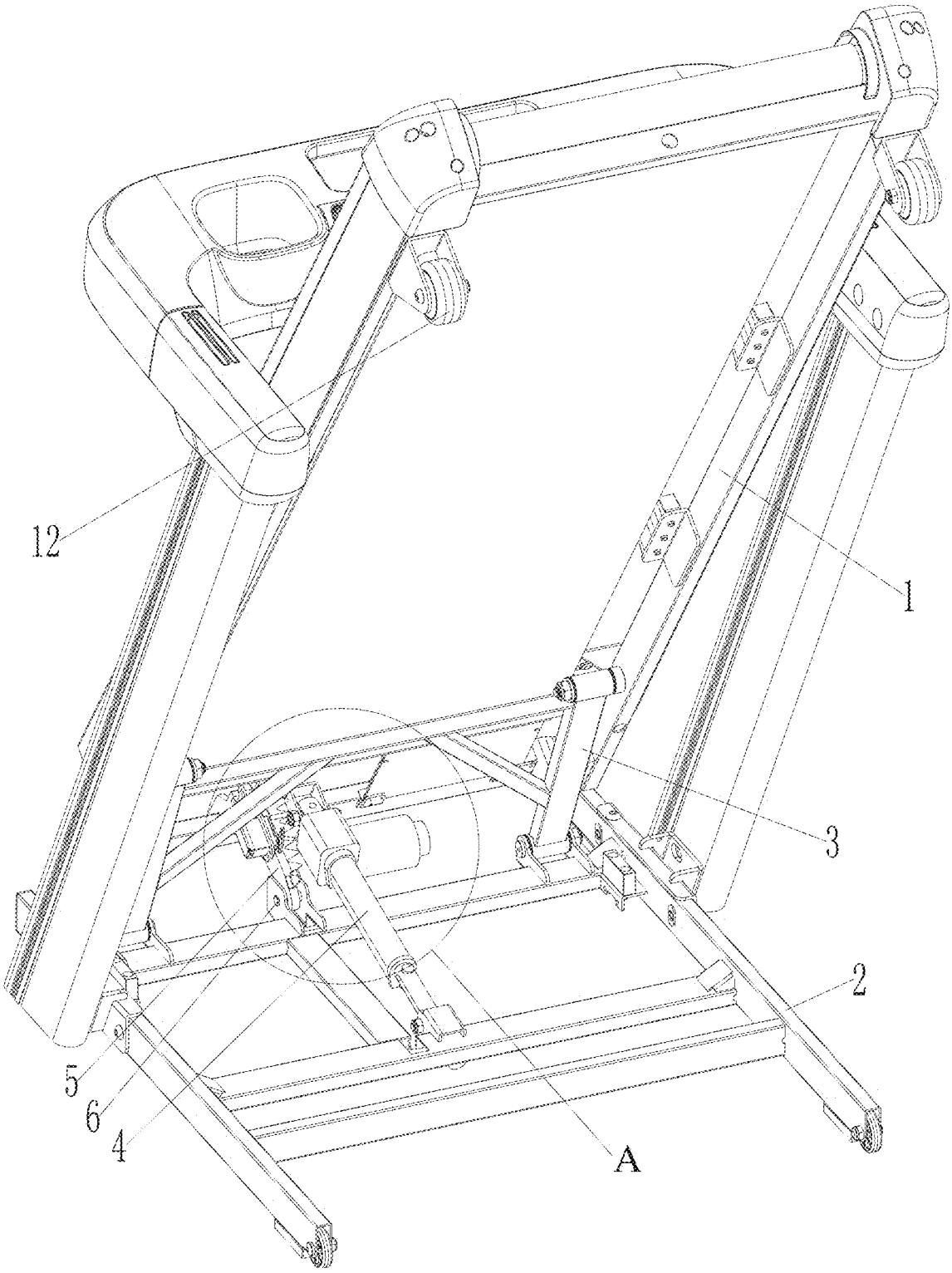
FIG. 1 is a three-dimensional view of a running deck when erected and folded.

Description of reference numerals: 1-running deck, 2-base, 3-support, 4-electric push rod, 5-hook, 6-lateral pin, 7-electric pushing device, 8-motor, 9-shifter lever, 10-eccentric portion, 11-elastic component, 12-roller, and 13-running belt.

DESCRIPTION OF EMBODIMENTS

The present disclosure is described in detail below with reference to the accompanying drawings and specific embodiments.

In the claims, specification, and drawings of the present disclosure, unless otherwise explicitly limited, the use of positional words such as "center", "transverse", "longitudinal", "horizontal", "vertical", "top", "bottom", "inside", "outside", "up", "down", "front", "back", "left", "right", "clockwise", and "counterclockwise" to indicate orientations or positional relationships is only for the convenience of describing the present disclosure and simplifying the description, rather than indicating or implying that the device or element referred to must have a particular orientation or be constructed and operated in a particular orientation, and therefore cannot be understood as limiting the specific scope of protection of the present disclosure.

The present disclosure provides a lifting and folding treadmill, as shown in FIGS. 1 to 6, including a running deck 1, a base 2, a support 3, an electric push rod 4, and a hook 5.

Figure 3:
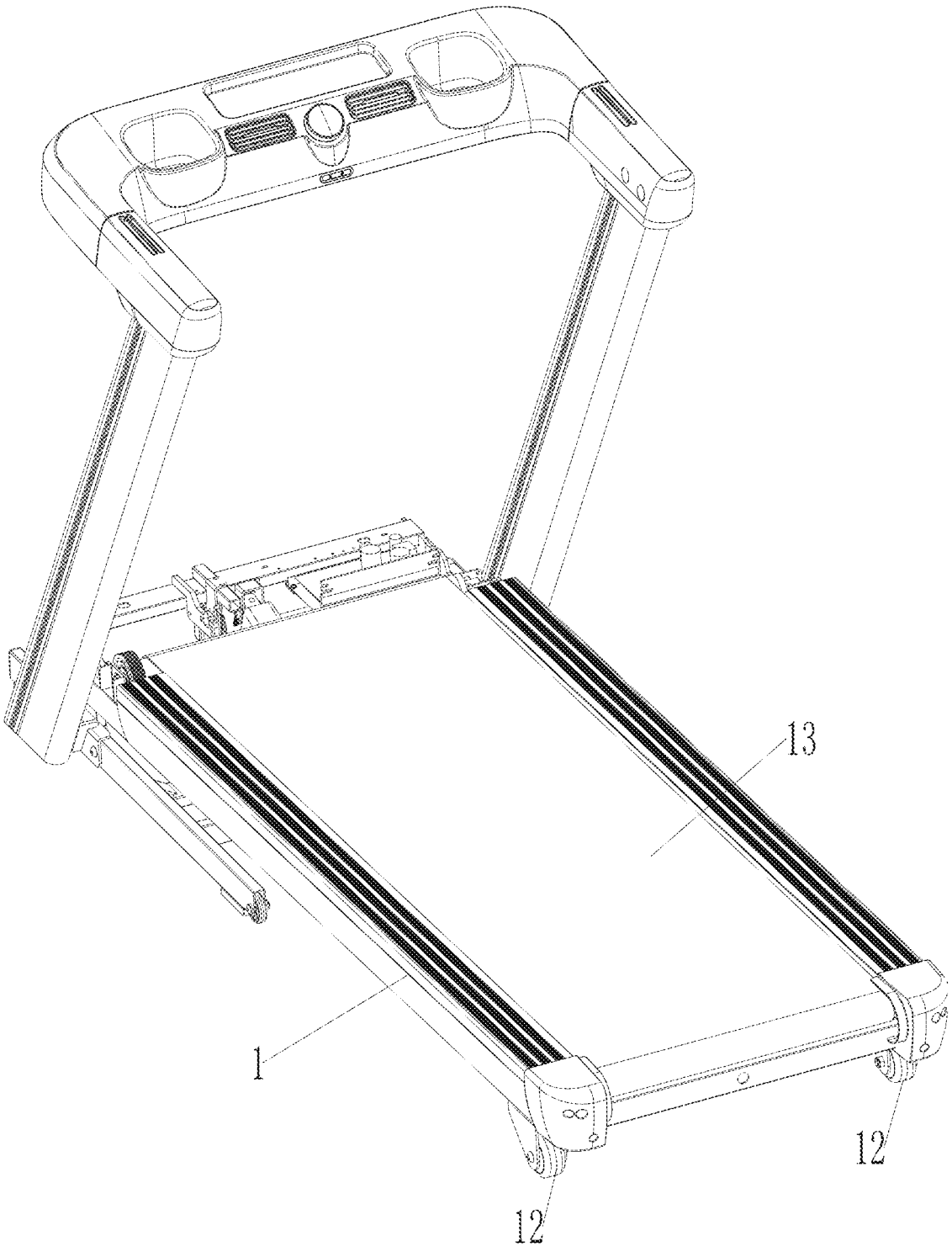
FIG. 3 is a three-dimensional view of a running deck when a rear part of the running deck falls back to the ground.
Figure 4:
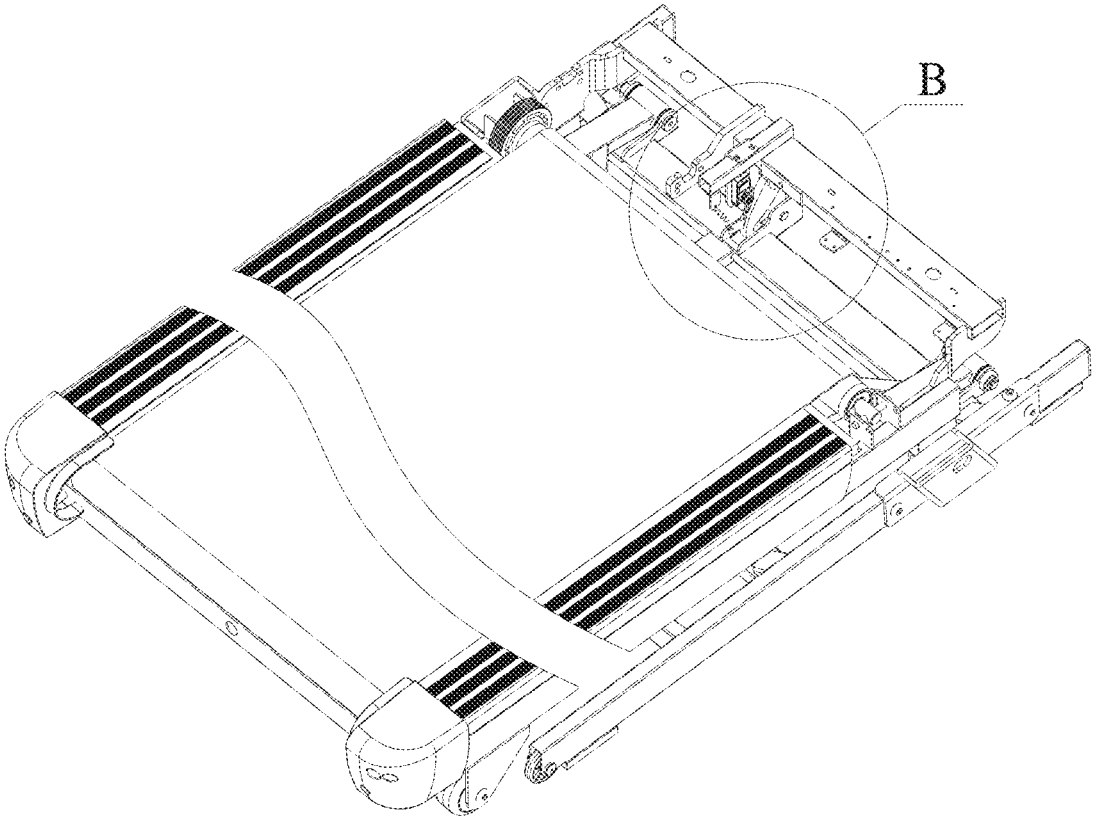
FIG. 4 is a schematic diagram of release of a hook from a lateral pin.

Emphatically referring to FIG. 3, a top side of the running deck 1 is provided with a running belt 13 along a front-rear direction.

Figure 6:
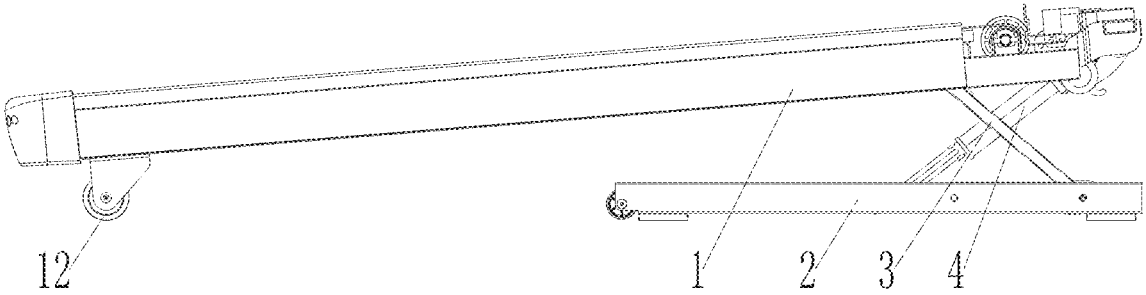
FIG. 6 is a schematic diagram of a running deck when a front part of the running deck is lifted up to form a slope.

Emphatically referring to FIG. 1 and FIG. 6, the base 2 is located below the running deck 1 and configured to be supported on the ground. To avoid occupying space after folding, the front-rear length of the base 2 is less than the front-rear length of the running deck 1, and the base 2 is located below a front part of the running deck 1.

A bottom end of the support 3 is pivoted to the base 2 by a pivot shaft extending leftwards and rightwards, so that a top end of the support 3 is capable of swinging forwards and backwards, and the top end of the support 3 is tilted backwards and is pivoted to a front half part of the running deck 1 by another pivot shaft extending leftwards and rightwards. One end of the electric push rod 4 is pivoted to the base 2 by a pivot shaft extending leftwards and rightwards, so that the other end of the electric push rod 4 is capable of swinging forwards and backwards, a pivot point between the electric push rod 4 and the base 2 is located behind a pivot point between the support 3 and the base 2, the other end of the electric push rod 4 is pivoted to the running deck 1 by another pivot shaft extending leftwards and rightwards, and a pivot point between the electric push rod and the running deck 1 is located in front of a pivot point between the support 3 and the running deck 1. Emphatically referring to FIG. 2 and FIG. 5, the hook 5 is configured to hook or release the front part of the running deck 1 to or from the base 2, so as to limit lifting of the front part of the running deck 1 after hooking, and cause the running deck 1 to swing synchronously with the support 3 when the electric push rod 4 extends or retracts. A rear part of the running deck 1 can be lifted up, so that the running deck 1 is erected and folded (emphatically referring to FIG. 1). When the running deck 1 is released from the base 2 by the hook 5, the rear part of the running deck 1 falls on the ground. At this time, when the electric push rod 4 extends or retracts, the support 3 swings forwards and backwards to drive the front part of the running deck 1 to ascend or descend, thereby adjusting the slope of the running deck 1 (emphatically referring to FIG. 6).

Figure 2:
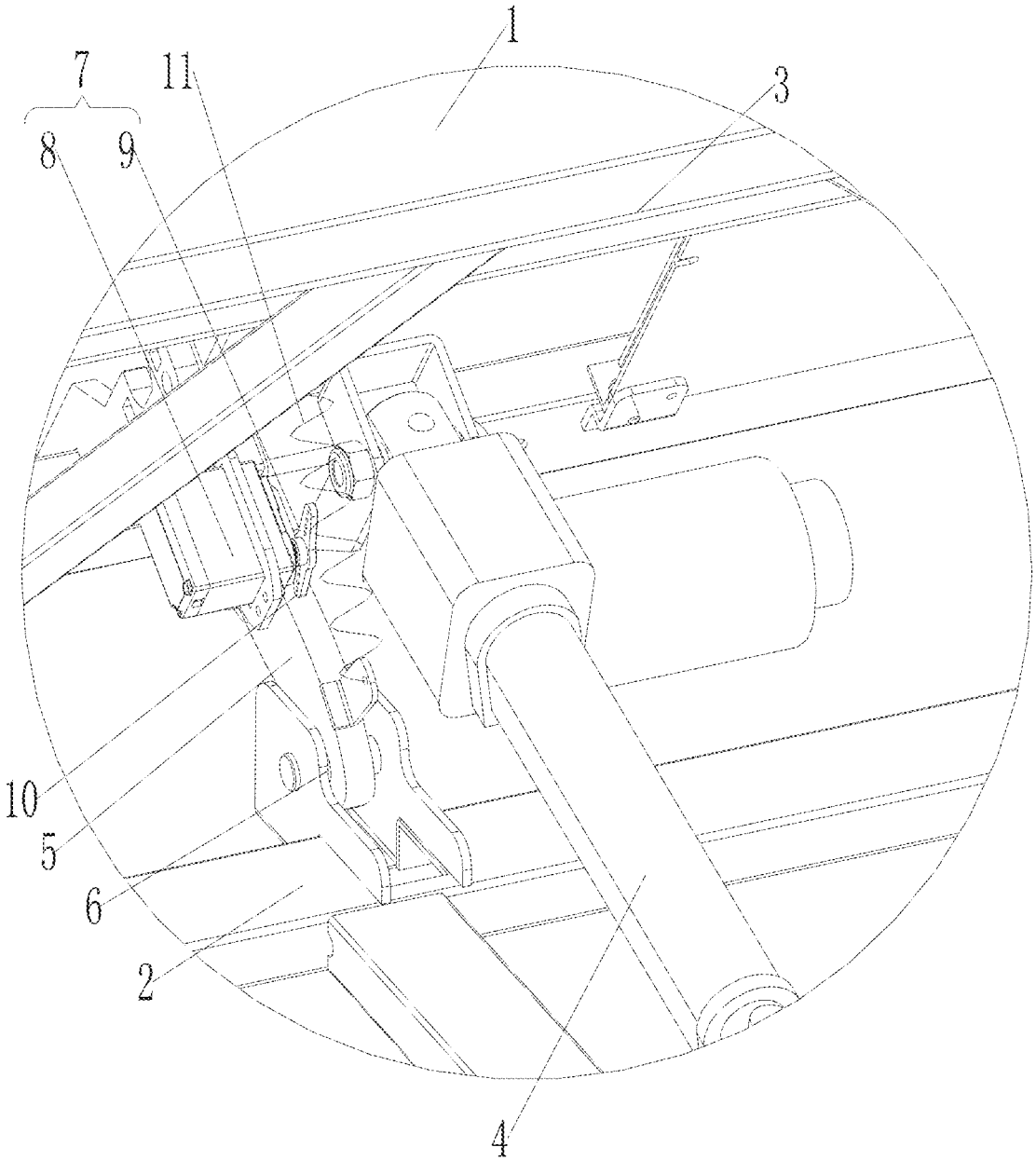
FIG. 2 is a partial enlarged view of a part A in FIG. 1.
Figure 5:
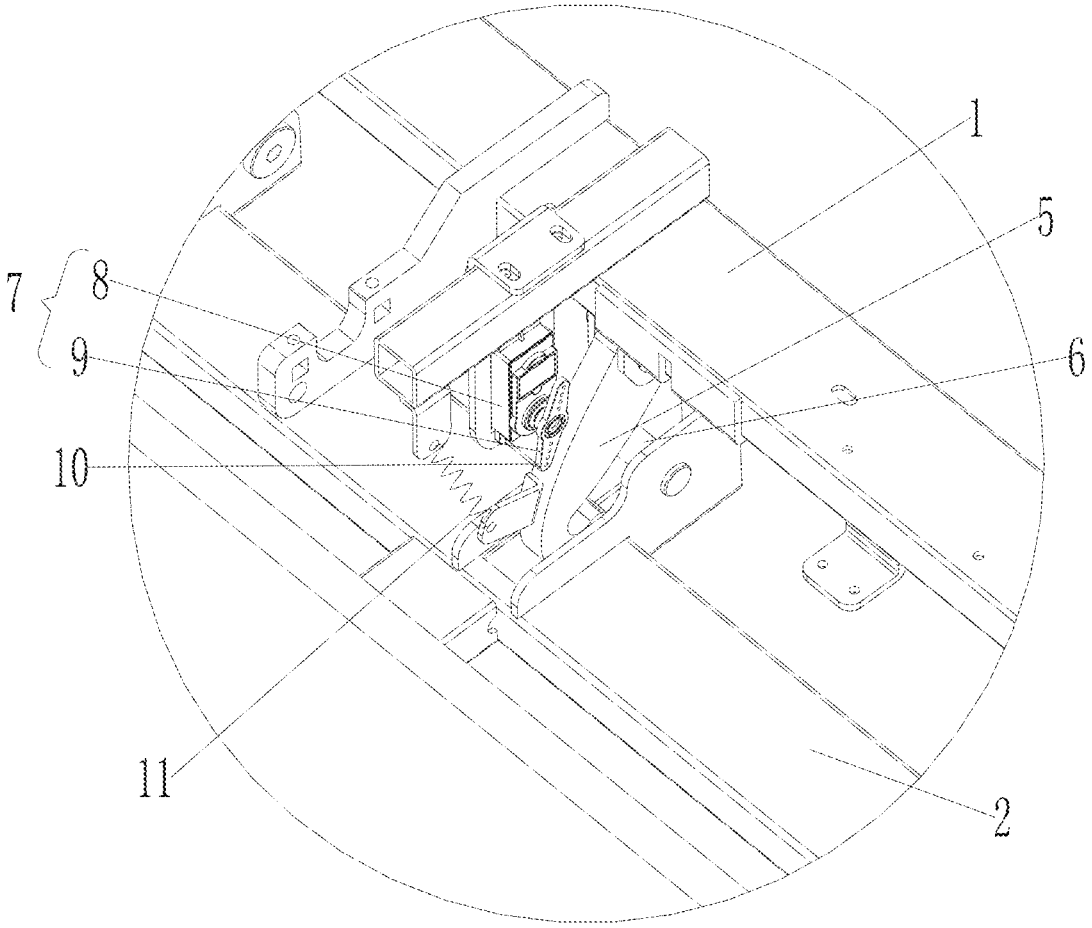
FIG. 5 is a partial enlarged view of a part B in FIG. 4.

Emphatically referring to FIG. 2 and FIG. 5, in a preferred embodiment, the base 2 is provided with a lateral pin 6, an axis of the lateral pin 6 is coaxial with a pivot shaft of the support 3 pivoted to the base 2, one end of the hook 5 is pivoted to the front part of the running deck 1, and the other end of the hook is capable of swinging forwards and backwards, so as to swing towards and be hooked on the lateral pin 6, or to swing away and be released from the lateral pin 6. In this way, the running deck 1 is more reliable and stable when swinging synchronously with the support 3.

Emphatically referring to FIG. 2 and FIG. 5, to electrically switch between release of the hook 5 and hooking to the base 2, the running deck 1 is mounted with an electric pushing device 7. The structure of the electric pushing device is not specifically limited, as long as the electric pushing device can be configured to push the hook 5 to swing towards the lateral pin 6, or to be released from the lateral pin 6. The hook 5 is connected to an elastic component 11, and the elastic component 11 elastically drives the hook 5 to swing away from the lateral pin 6. In this way, when the electric pushing device 7 releases the hook 5, the elastic component 11 drives the hook 5 to separate from the lateral pin 6. In a more preferred embodiment, the electric pushing device 7 includes a motor 8 and a shifter lever 9, where the motor 8 is mounted on the running deck 1 and drives the shifter lever 9 to rotate, the shifter lever 9 is formed with an eccentric portion 10, and after the shifter lever 9 rotates, the eccentric portion 10 is driven to push the hook 5 to swing towards the lateral pin 6, or to be released from the lateral pin 6. In this way, the electric pushing device 7 has a simpler structure.

To avoid causing strong friction at a position of contact between the rear part of the running deck 1 and the ground during slope adjustment of the running deck 1, a bottom side of the rear part of the running deck 1 is mounted with rollers 12 for forward and backward rolling. Sliding friction is converted into rolling friction by the rollers 12.

The above descriptions are only preferred embodiments of the present disclosure, and are not limitations to the design of the present disclosure. Any equivalent changes made according to the design key points of the present disclosure fall within the scope of protection of the present disclosure.

The invention claimed is:

1. A lifting and folding treadmill, comprising a running deck, a base, a support, an electric push rod, and a hook, wherein the base is located below the running deck and configured to be supported on ground;

a bottom end of the support is pivotally connected to the base, so that a top end of the support is configured to swing forwards and backwards, and the top end of the support is configured to be tilted backwards and pivoted to a front half part of the running deck;

one end of the electric push rod is pivotally connected to the base, so that a second end of the electric push rod is configured to swing forwards and backwards, a pivot point between the electric push rod and the base is located behind a pivot point between the support and the base, the second end of the electric push rod is pivotally connected to the running deck, and a pivot point between the electric push rod and the running deck is located in front of a pivot point between the support and the running deck; and the hook is configured to hook a front part of the running deck to the base and release the front part of the running deck from the base, so as to inhibit lifting of the front part of the running deck after hooking and cause the running deck to swing synchronously with the support.

2. The lifting and folding treadmill according to claim 1, wherein the base is provided with a lateral pin having an axis coaxial with a pivot shaft of the support pivotally connected to the base, one end of the hook is pivotally connected to the front part of the running deck, and a second end of the hook is configured to swing forwards so as to swing towards and be hooked on the lateral pin and to swing backwards so as to be released from the lateral pin.

3. The lifting and folding treadmill according to claim 2, wherein the running deck is mounted with an electric pushing device configured to push the hook to swing towards the lateral pin, or to be released from the lateral pin.

4. The lifting and folding treadmill according to claim 3, wherein the electric pushing device comprises a motor and a shifter lever, the motor is mounted on the running deck and drives the shifter lever to rotate, the shifter lever is formed with an eccentric portion, and after the shifter lever rotates, the eccentric portion is driven to push the hook to swing towards the lateral pin, or to be released from the lateral pin.

5. The lifting and folding treadmill according to claim 2, wherein the hook is connected to an elastic component, and the elastic component elastically drives the hook to swing away from the lateral pin.

6. The lifting and folding treadmill according to claim 1, wherein when the hook is released from the base, a rear part of the running deck falls on the ground.

7. The lifting and folding treadmill according to claim 6, wherein a bottom side of the rear part of the running deck is mounted with rollers for frontward and backward rolling.

8. The lifting and folding treadmill according to claim 1, wherein a top side of the running deck is provided with a running belt along a front-rear direction.

* * * * *